United States Patent [19]

Dantinne

[11] 4,428,164

[45] Jan. 31, 1984

[54] APPARATUS FOR THE CONTINUOUS POLISHING AND THE UNIFORM COOLING OF THE FACE OF A ROLLING MILL WORK ROLL MOUNTED IN ITS STAND

[75] Inventor: Pierre G. Dantinne, Seraing, Belgium

[73] Assignee: Cockerill Sambre, Belgium

[21] Appl. No.: 217,384

[22] Filed: Dec. 17, 1980

[30] Foreign Application Priority Data

Dec. 27, 1979 [BE] Belgium ..... 198771

[51] Int. Cl.[3] ..... B24B 5/00

[52] U.S. Cl. ..... 51/252

[58] Field of Search ..... 51/251, 252, 253, 255, 51/154, 67, 262 T, 142

[56] References Cited

U.S. PATENT DOCUMENTS

| | | | |
|---|---|---|---|
| 891,694 | 6/1908 | Hill | 51/255 |
| 1,018,163 | 2/1912 | Cavill | 51/253 |
| 1,212,131 | 1/1917 | Coate | &51/252 |
| 1,327,639 | 1/1920 | Stevens | 51/255 |
| 1,590,386 | 6/1926 | Lavallee | 51/262 T |
| 1,672,462 | 6/1928 | Mansell | 51/255 |
| 1,904,385 | 4/1933 | Poliny | 51/252 |
| 1,954,716 | 4/1934 | Stoughton | 51/253 |
| 2,714,787 | 8/1955 | Orr | 51/142 |

*Primary Examiner*—Harold D. Whitehead

*Attorney, Agent, or Firm*—Hill, Van Santen, Steadman & Simpson

[57] ABSTRACT

An apparatus which comprises at least one abrasive rubbing element mounted on a retractable support extending over all the width of the roll face. The abrasive rubbing element is applied with a predetermined pressure against the roll face during operation.

1 Claim, 3 Drawing Figures

APPARATUS FOR THE CONTINUOUS POLISHING AND THE UNIFORM COOLING OF THE FACE OF A ROLLING MILL WORK ROLL MOUNTED IN ITS STAND

BACKGROUND OF THE INVENTION

The present invention relates to an apparatus and a method for polishing continuously and cooling uniformly the barrel or face of a rolling mill work roll mounted in its stand. The invention is applicable to the rolling of flat metallurgical products and more particularly to the hot rolling of steel strips.

Since users are becoming more and more demanding as regards the quality of the surface appearance of rolled strips, it is important nowadays to improve certain rolling factors which have an influence on this quality.

Among these factors three should be mentioned the physical state of the roll face, which should have a correct profile and a suitable and uniform standard of roughness, and the thermal state of this face which should have as uniform surface temperatures as possible over its entire zone in contact with the metallurgical product.

Concerning the physical state of the face, is should be mentioned that, during hot rolling of strips, oxide incrustations often adhere to the rolls especially those of the first three finishing stands. Contacting the strips during processing, these incrustations produce imprints in the faces of these strips and substantially impair their outward appearance. This results in a considerable amount of rejection and downgrading in rolled strips. Moreover these same incrustations cause rapid damaging of the roll faces, and result in the rolls having to be replaced frequently.

To maintain the profile of the roll face and to remove oxide incrustations, a device has already been provided for polishing this face during the rotational movement of the roll during rolling. This known device comprises mainly a pumice stone fixed to a support having a screwthreaded bore through which a worm extends which is disposed parallel to the axis of rotation of the roll, over the entire length of the roll face. By the action of a reversible electric motor the worm rotates slowly about its longitudinal axis in one direction over a travel corresponding to the length of the face and in the opposite direction over the reverse travel. Therefore, the pumice stone sweeps the face of the roll with an alternating movement over the entire length of the said face, and polishes the latter to a greater or less degree during rolling.

However, the pumice stone is particularly short, and bears against the roll face only over a relatively short length. Also, the pumice stone is displaced slowly along the face, and returns to any one zone after several revolutions of the roll. Consequently the known device can smooth the roll face only locally and temporarily, and removes oxide incrustations only periodically and locally.

Concerning the thermal state of the roll face, it must be pointed out that during rolling the rolls are already cooled by a series of jets of water sprayed on to a roll face zone situated slightly downstream of the zone of contact with the steel strip, considered in the direction of rotation of these rolls.

However, the water projected on to the rolls is not collected, and is dispersed uselessly below these rolls.

The cooling of the roll faces with water thus results from rapid contact between this water and the roll face, and can take place only to an irregular extent over the entire length of the said face.

SUMMARY OF THE INVENTION

The invention has as its object to improve both the physical state and the thermal state of the faces of such rolls during rolling so as to make the said face uniformly smooth without detrimentally affecting its profile, and to cool it uniformly both as regards its diameter and also over its length without additional water consumption over and above what has obtained hitherto.

For this purpose the invention provides an apparatus which comprises at least one abrasive rubbing element. The abrasive rubbing element is mounted on a retractable support extending parallel to the axis of rotation of the roll over the entire length of the roll face. This abrasive rubbing element can be applied against this roll face with a predetermined pressure when the roll rotates. In this way the abrasive rubbing element retains to a considerable extent the cooling water entrained by the face of the rotating roll to form there a cushion of water extending longitudinally and making temperatures uniform over the length of the roll face. Moreover this abrasive rubbing element smooths the roll face and removes oxide incrustations therefrom.

It is also important to note that because of the new apparatus the rolling mill work rolls can advantageously be preserved against rapid wear and deterioration which could be caused by oxide incrustations, and consequently a better surface appearance can be ensured for the rolled strips. As a result, it is possible to reduce the down times when rolling is halted to change rolls, and to increase the tonnage of rolled strips with the same pair of such rolls. Likewise the rolls need truing less frequently. It is also possible to increase the speed at which rolled strips can be pickled. Finally, flat metallurgical products where surface appearance is of chief importance can be rolled with greater efficiency.

Generally, in the new apparatus the support comprises a single abrasive rubbing element extending over the entire length of the roll face.

So that the new apparatus can be used for mill rolls with varying diameters, the abrasive rubbing element can be adjusted as to height relatively to the axes of rotation of the rolls.

To avoid forming circular ridges on the face at the ends of the abrasive rubbing element of the new apparatus, this rubbing element is slightly displaced with an alternating movement in a direction parallel to the axis of rotation of the roll during the said rotation.

In order to prevent deterioration of the roll face when the abrasive rubbing element of the new apparatus is sufficiently worn, the support of this rubbing element carries a wear detector which, when it contacts the roll, withdraws the said rubbing element from the said roll.

Generally, given the relatively considerable length of the face of a rolling mill roll, the abrasive rubbing element of the new apparatus comprises consecutive abrasive part-elements or segments whose surfaces in mutual contact and also the end faces of the row are oblique relatively to the longitudinal direction of the said row. This feature of the abrasive rubbing element makes it possible to avoid producing circular projections on the roll face during operation at the joints between rubbing element segments and at the ends of the said rubbing element.

The manner in which the abrasive rubbing element of the new apparatus is constituted is optional. Thus, the abrasive rubbing element or each segment of such an element may be constituted of an abrasive pad or on the other hand of a plurality of abrasive sheets arranged superposed and clamped on one another in their housing in the support.

According to an assembly feature of the new apparatus used with the lower work roll, the support of the abrasive rubbing element relating to this roll is mounted on two lateral rockers pivoting about two coaxial lateral pivots fixed relatively to the outlet table. This support is pivotably connected to pneumatic cylinder rods controlling its displacement and providing the pressure applying this rubbing element against this roll. The bodies of these pneumatic cylinders carry two coaxial lateral journals and pivot relatively to the said outlet table. In this case the support of the abrasive rubbing element is preferably in the form of an angle member one of whose flanges is prolonged by this rubbing element.

According to another mounting or assembly feature of the new apparatus used with the upper work roll, the support of the abrasive rubbing element related to this upper roll pivots about lateral pivots which are coaxial and are fixed relatively to the upper portion of the stand frame, under the action of pneumatic cylinders which also provide the pressure applying this rubbing element against this roll. These pneumatic cylinders are pivotably connected at their rods to this support and by their bodies to two other coaxial lateral pivots which are also fixed relatively to the upper portion of this frame. In this case the pivots of the support of the abrasive element and of the pneumatic cylinders are mounted preferably on a common plate rendered integral with the portion of the frame carrying more particularly the upper scraper and the sprinkling pipes of the upper roll.

The invention also proposes a method employing the new apparatus. According to the new method, an abrasive rubbing element is applied against the face of the rotating roll under a pressure which is predetermined, on the one hand, for retaining the cooling water entrained by said face and forming against the latter a longitudinal cushion of water cooling it over its entire length and, on the other hand, for smoothing the face by removing oxide incrustations. The abrasive rubbing element is preferably displaced slightly and to and fro in a direction parallel to the axis of rotation of the roll during its rotation.

Other details and features of the invention will be brought out during the course of the description to follow and the drawings attached hereto which illustrate diagrammatically several exemplary embodiments of the invention.

DESCRIPTION OF THE DRAWINGS

In these various Figures the same reference numerals are used to designate identical parts.

DESCRIPTION OF EXEMPLARY EMBODIMENTS

Figure 1:
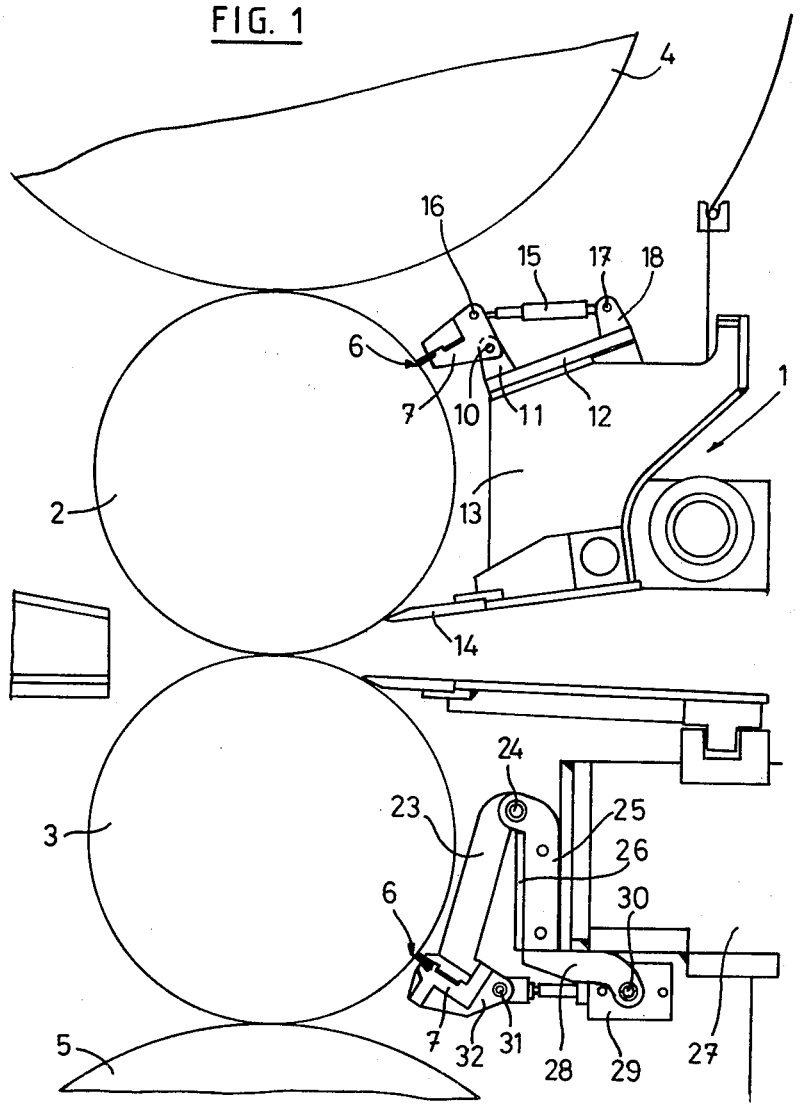
FIG. 1 shows a view in elevation of the rolls of a rolling mill stand equipped with two apparatus according to the invention applied to these rolls respectively.

The apparatus shown are used in pairs in the stands of rolling mills for the hot rolling of steel strips for example. In fact the two apparatus associated with a stand 1 serve to polish continuously and cool uniformly the two work rolls: upper 2 and lower 3, co-operating with the upper backing-up roll 4 and lower backing-up roll 5 situated in this stand 1. The two apparatus can equally well be used with rolls 2 and 3 in finishing stands as with those used in roughing stands.

Each apparatus comprises substantially an abrasive rubbing element 6 which extends parallel to the axis of rotation of the roll 2 or 3 for example over the entire length of this roll 2 or 3. In operation, the abrasive rubbing element 6 is applied against the face of the rotating roll 2 or 3 with a predetermined elastic pressure.

The abrasive rubbing element 6 is mounted on a retractable support 7 which extends parallel to the axis of rotation of the roll 2 or 3 and which is thus equidistant from the face of said roll. The support 7 is adapted to be displaced relatively to the face of the roll 2 or 3 whilst remaining parallel to itself and parallel to the axis of rotation of this roll 2 or 3. In general the support 7 extends over the entire length of the said face.

Figure 2:
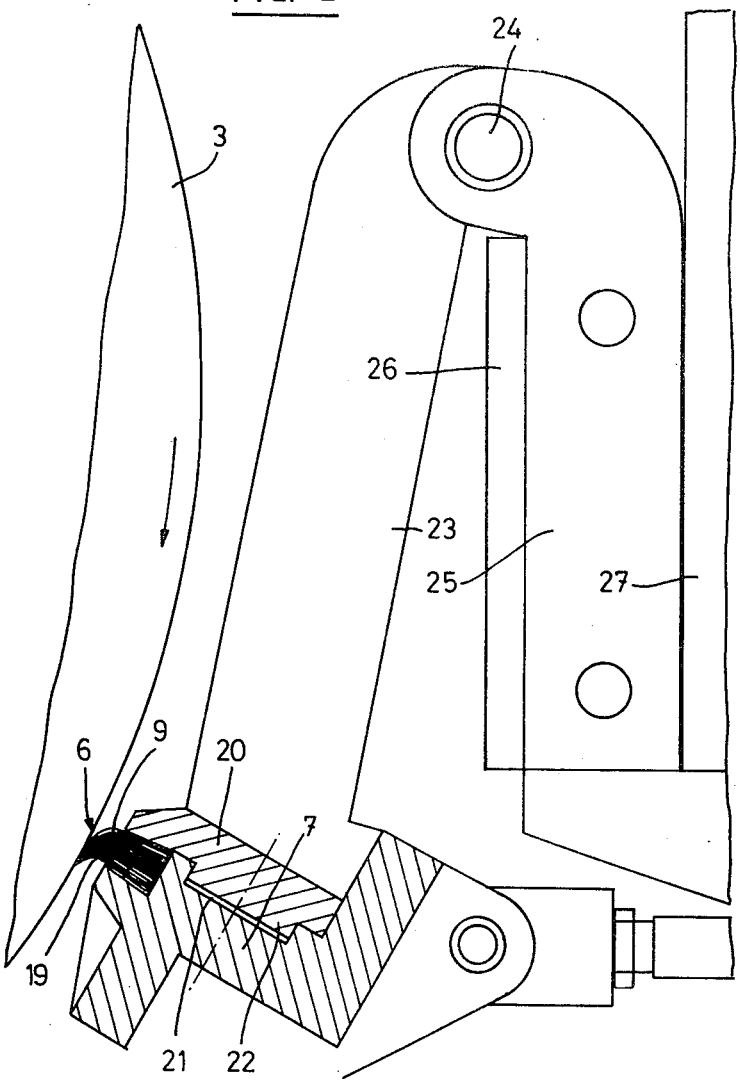
FIG. 2 shows a first form of embodiment of the abrasive rubbing element of the new apparatus.
Figure 3:
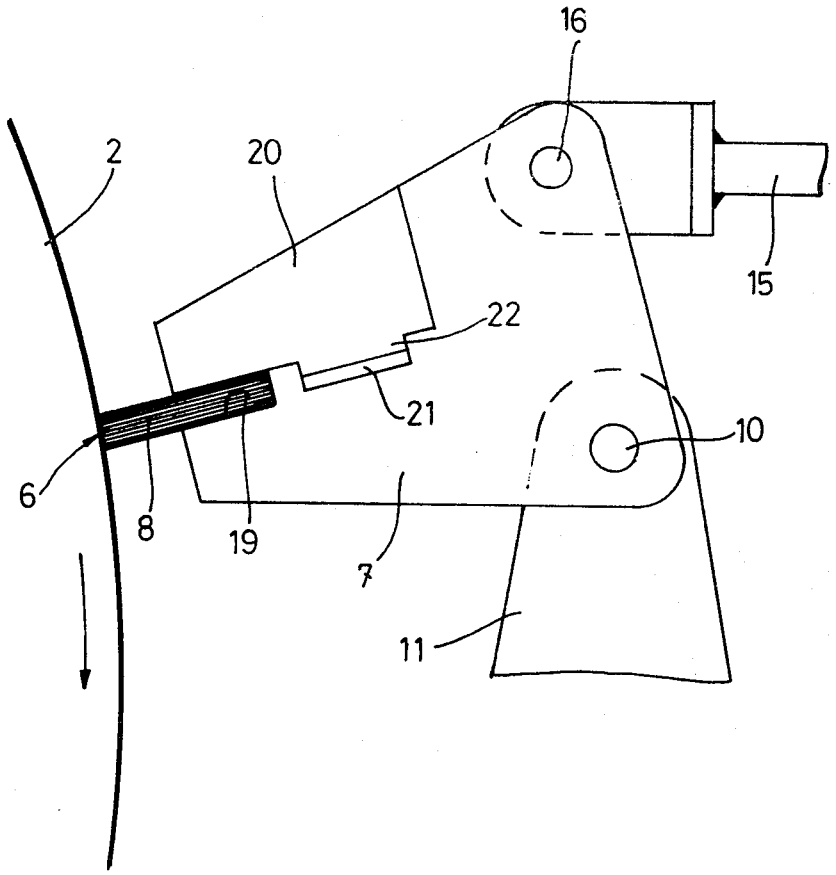
FIG. 3 illustrates a second form of embodiment of the abrasive rubbing element of the new apparatus.

In practice each retractable support 7 carries a single rubbing element 6, which may be constituted by a single piece or formed of a straight row of successive rubbing element segments bearing against one another. In each case the rubbing element 6 or each element segment may comprise a block or pad 8 of abrasive material (FIG. 3) or an assembly of several abrasive sheets 9 which are superposed and clamped on one another in their housing on the support 7 (FIG. 2). Advantageously, when the rubbing element 6 comprises a plurality of successive element segments, the mutual bearing contact faces of these segments, and the end faces of the row, are situated obliquely relatively to the longitudinal direction of the said row, that is to say relatively to the axis of roll 2 or 3. In this way the junction lines and the end lines where these segments contact the face of roll 2 or 3 gradually cover a zone of said roll face when the rubbing element 6 wears down against said face.

Whether it is the upper roll 2 or the lower roll 3, the abrasive rubbing element 6 applied during operation continuously against the face of the said roll during rotation smooths this face continuously and retains for the greater part the cooling water sprayed against the roll 2 or 3. Indeed the rubbing element 6 forms along its line of contact with the face of roll 2 or 3 a cushion of cooling water by means of which the temperatures of said face are made more uniform over its entire length. By way of example, thanks to the new apparatus there may be mentioned temperature differences of 5° to 7° C. between the central portion and the ends of the rolls 2 or 3 having a length of 2.250 m and used in finishing stands of a continuous hot mill train for steel strip. Moreover, in smoothing the face the rubbing element polishes it and removes therefrom the oxide incrustations which are detrimental not only to the life of the rolls 2 and 3 but also to the quality of the rolled strips. In this respect, a life of as much as 2300 to 2500 tons of rolled strip may be quoted as being achieved thanks to the use of the new apparatus, instead of 1500 to 1800 tons.

So as to be adaptable to rolls 2 and 3 of variable diameters, the support 7 of each abrasive rubbing element 6 is adjustable in height relatively to the axis of rotation of the corresponding roll 2 or 3.

So as not to striate the face of the roll 2 or 3 in rotational movement during the application of the abrasive rubbing element 6 against the face, the apparatus may comprise mechanical means capable of transmitting to the said support 7 a slight reciprocating motion in the axial direction of this roll 2 or 3 during the rotational movement of the said roll.

With the aim of preventing any contact between the face of the roll 2 or 3 and the support 7, the apparatus is provided with a device for detecting the wear on the abrasive rubbing element 6. This detector is mounted on the support 7 and causes the rubbing element 6 to withdraw from the roll face when it comes in contact with the roll 2 or 3.

In the case of the upper roll 2, the support 7 pivots about two coaxial lateral pivots 10 carried each by two parallel lugs 11 fixed to a common plate 12 fast with the upper portion 13 of the frame of stand 1. Indeed, the plate 12 is mounted on the upper portion of the frame which supports more particularly the upper scraper 14 and pipes for sprinkling the roll 2.

On the other hand, the rocking or pivoting of the support 7 about pivots 10 is controlled by pneumatic cylinders 15 supplied synchronously with compressed air. Each pneumatic cylinder 15 is connected on the one hand by its piston rod for pivoting movement about a pivot 16 fast with the support 7 above the pivot 12, and on the other hand by its cylinder body for pivoting movement about a pivot 17 carried by two parallel lugs 18 fixed to the common plate 12. It is to be noted that the two mobile lateral pivots 16 of the support 7 are aligned coaxially as are also the two lateral pivots 17 which are in stationary positions. The pneumatic cylinders 15 thus control the displacement of the support 7 relatively to the cylinder 2 and determine the pneumatic pressure applying the abrasive rubbing element 6 against the face of this roll 2. The abrasive rubbing element 6 is situated in a recess 19 of the support 7 and is clamped therein by means of a clamping plate 20 which is bolted thereon. Preferably the support 7 comprises near the recess 19 a groove 21 in which a rib 22 of the plate 20 is fitted without play.

In the case of the lower roll 3, the support 7 is in the form of an angle member one flange of which is prolonged by the abrasive rubbing element 6. Indeed, this flange has a recess 19 similar to the aforementioned for receiving the rubbing element 6, and carries a pressure plate 20 bolted-on for the clamping of this rubbing element 6. Advantageously, the said flange has a longitudinal groove 21 in which a corresponding rib 22 of the plate 20 is fitted without play.

The angle member is mounted on two identical lateral rockers 23 extending upwardly. The rockers 23 are articulated at their upper ends about two coaxial lateral pivots 24 on lateral elbowed supports 25. Each elbowed support 25 comprises two parallel vertical flanges which are bolted to an I-piece 26 and which are fitted respectively between the flanges of this piece 26 on the two sides of its web. The I-piece 26 is fixed vertically by welding to the outlet table 27 of the stand 1. Each elbowed support 25 also comprises two parallel horizontal flanges prolonged at the side opposite from the roll 3 by arms 28 downwardly bent over and adapted to carry a pneumatic cylinder 29. For this purpose the bent-over arms 28 comprise two coaxial circular apertures serving as bearings for two journals 30 fixed to the cylinder 29, which can thus pivot relatively to the support 25 and the outlet table 27. Each cylinder 29 has its piston rod pivotably connected by a pivot 31 to a lug 32 fast with the support 7. In this way the support 7 can rock about the horizontal axis of the pivots 24, more particularly under the action of the pneumatic cylinders 29 on the piston rods of which it is pivotably connected, these cylinders 29 pivoting about the axis of the journals 30 and in fact determining the pressure with which the abrasive rubbing element 6 is applied against the face of roll 3.

The new apparatus described hereinbefore allows the use of a new method for polishing continuously and cooling uniformly the face of the roll 2 or 3 during rotational movement. According to the new method, the abrasive rubbing element 6 is applied against the face of the upper roll 2 or lower roll 3 as appropriate under a predetermined pneumatic pressure produced by the cylinders 15 or 20 respectively. In this way, the cooling water entrained by the face of the rotating roll is retained and a longitudinal cushion of water is formed against the said roll face, which cools the said face over its entire length. At the same time the rubbing element 6 smooths the roll face and removes therefrom more particularly the oxide incrustations.

It will be apparent that the invention is not exclusively limited to the forms of embodiment represented here, and that many modifications may be made to the form, the arrangement and the constitution of some of the elements used in the said forms of embodiment provided that such modifications do not contradict the subject of any of the following claims.

What is claimed is:

1. In an apparatus for the continuous polishing and uniform cooling of the face of a rolling mill work roll mounted in its stand, the improvement of at least one abrasive rubbing element, the rubbing element being mounted on a retractable support extending parallel to the axis of rotation of a lower roll and with the rubbing element extending over the entire length of the roll face, and which is adapted to be applied against the face of the roll as it rotates, the abrasive rubbing element being comprised of a plurality of abrasive sheets which are superposed and clamped against one another in their housing on the support, the support and the abrasive rubbing element being associated with the lower roll and being mounted on two lateral rockers, the rockers being pivoted about two coaxial lateral pivots fixed relative to an outlet table, pneumatic cylinders having rods pivotably connected to the support for controlling displacement of the rods and providing the pressure applied to the rubbing element against said roll, the bodies of said pneumatic cylinders having two coaxial lateral journals and being pivoted relative to the outlet table on said journals, the pneumatic cylinders providing means for exerting a predetermined pressure to the abrasive rubbing element for enabling cooling water to be entrained along the face of the roll during rotation to form a longitudinal cushion of water making the temperature of the face substantially uniform over its length, while the abrasive rubbing element also operates to smooth the roll face and removes oxide incrustrations therefrom, wherein the support for the abrasive rubbing element is in the form of an angle member, said rubbing element being situated in prolongation of one of the flanges of said angle member, wherein the support comprises a second abrasive rubbing element formed of said plurality of sheets extending over the entire length of the face of the roll, characterized by the support of the second abrasive rubbing element being associated with an upper roll, the support being pivotal about coaxial lateral pivots which are fixed relatively to the upper portion of the stand frame, pneumatic cylinders also providing the pressure applying said rubbing element against said upper roll, said pneumatic cylinders for cooperating with the upper roll being connected by their rods to the support, the cylinders having their bodies mounted on coaxial lateral pivots, and wherein the pivots allowing articulation of the support of the second abrasive rubbing element and the pneumatic cylinders are mounted on a common plate, the plate being held fast to the frame.

* * * * *